US011690459B1

(12) United States Patent
McCloud

(10) Patent No.: US 11,690,459 B1
(45) Date of Patent: Jul. 4, 2023

(54) BED WITH ADJUSTABLE BACKREST

(71) Applicant: Dana McCloud, Bradenton, FL (US)

(72) Inventor: Dana McCloud, Bradenton, FL (US)

( * ) Notice: Subject to any disclaimer, the term of this patent is extended or adjusted under 35 U.S.C. 154(b) by 0 days.

(21) Appl. No.: 17/676,366

(22) Filed: Feb. 21, 2022

(51) Int. Cl.
*A47C 17/16* (2006.01)

(52) U.S. Cl.
CPC ..... *A47C 17/16* (2013.01); *A47C 17/162* (2013.01)

(58) Field of Classification Search
CPC ..... A47C 17/16; A47C 17/162; A47C 19/022; A47C 19/22; A47C 21/00; A61G 7/0506
USPC ..... 5/59.1, 51.1, 53.1, 18.1, 19, 658
See application file for complete search history.

(56) References Cited

U.S. PATENT DOCUMENTS 1,304,579 A * 5/1919 Lipps ..... A47C 7/546 297/411.27
2,645,788 A 7/1953 Knoll et al.
2,710,412 A 6/1955 Bayer
4,217,669 A * 8/1980 Fefferman ..... A47C 17/162 297/65
4,447,920 A * 5/1984 Rosen ..... A47C 17/16 5/59.1
4,569,093 A * 2/1986 Hermann ..... A47C 17/1756 5/47
4,696,069 A * 9/1987 Crosthwaite ..... A47C 17/1756 5/47
4,821,349 A * 4/1989 Cohen ..... A47C 19/022 5/183
5,038,422 A * 8/1991 Messina ..... A47C 17/32 5/21
5,067,187 A * 11/1991 Messina ..... A47C 17/32 5/52
5,344,216 A * 9/1994 Suominen ..... A47C 1/023 297/383

FOREIGN PATENT DOCUMENTS

DE 20204325 U1 * 7/2002 ..... A47C 1/023

* cited by examiner

*Primary Examiner* — Robert G Santos
(74) *Attorney, Agent, or Firm* — Sanchelima & Associates, P.A.; Christian Sanchelima; Jesus Sanchelima

(57) ABSTRACT

A bed with an adjustable backrest including a bed assembly and a backrest assembly. The bed assembly includes a mattress and a bed frame having lateral rods. The backrest has a plurality of rods defining a rectangular backrest. The backrest assembly further includes a cushion pad attached to the plurality of rods. The backrest has mounting members to slidably attach the backrest to the lateral bars of the bed frame. The backrest can be slidably positioned into any position along the bed frame.

1 Claim, 5 Drawing Sheets

BED WITH ADJUSTABLE BACKREST

1. Field of the Invention

The present invention relates to beds and, more particularly, to a bed having an adjustable backrest.

2. Description of the Related Art

Several designs for beds have been designed in the past. None of them, however, include a bed with an adjustable backrest having a repositionable back rest.

Applicant believes that a related reference corresponds to U.S. Pat. No. 2,710,412 issued for a sofa bed having a detachable backrest. Applicant believes that another related reference corresponds to U.S. Pat. No. 2,645,788 issued for a sofa bed with a shiftable back. None of these references, however, teach of a bed with an adjustable backrest including a frame having a repositionable back rest which is slidingly attachable to the bed frame.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a bed with an adjustable backrest that has a backrest that allows adjusting the position of the backrest along the frame of the bed to allow a user seating on the bed.

It is another object of this invention to provide a bed with an adjustable backrest that includes a padded backboard for comfort of a user.

It is still another object of the present invention to provide a bed with an adjustable backrest that is easy to install to any bed frame.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
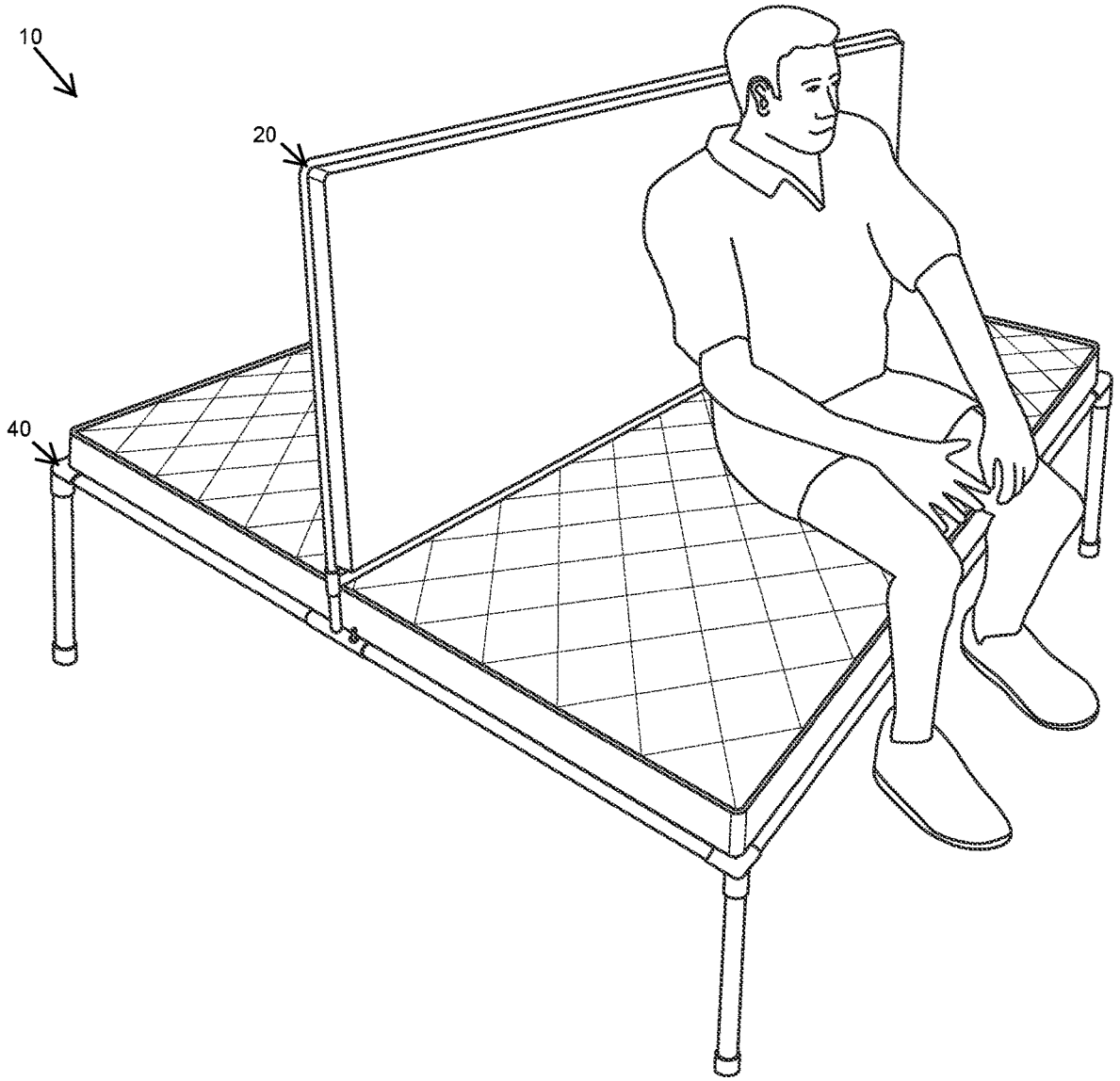

With the above and other related objects in view, the invention consists in the details of construction and combination of parts as will be more fully understood from the following description, when read in conjunction with the accompanying drawings in which:

FIG. 1 represents an isometric operational view of the present invention 10. A user can comfortably seat and support the back on the backrest assembly 20.

Figure 2:
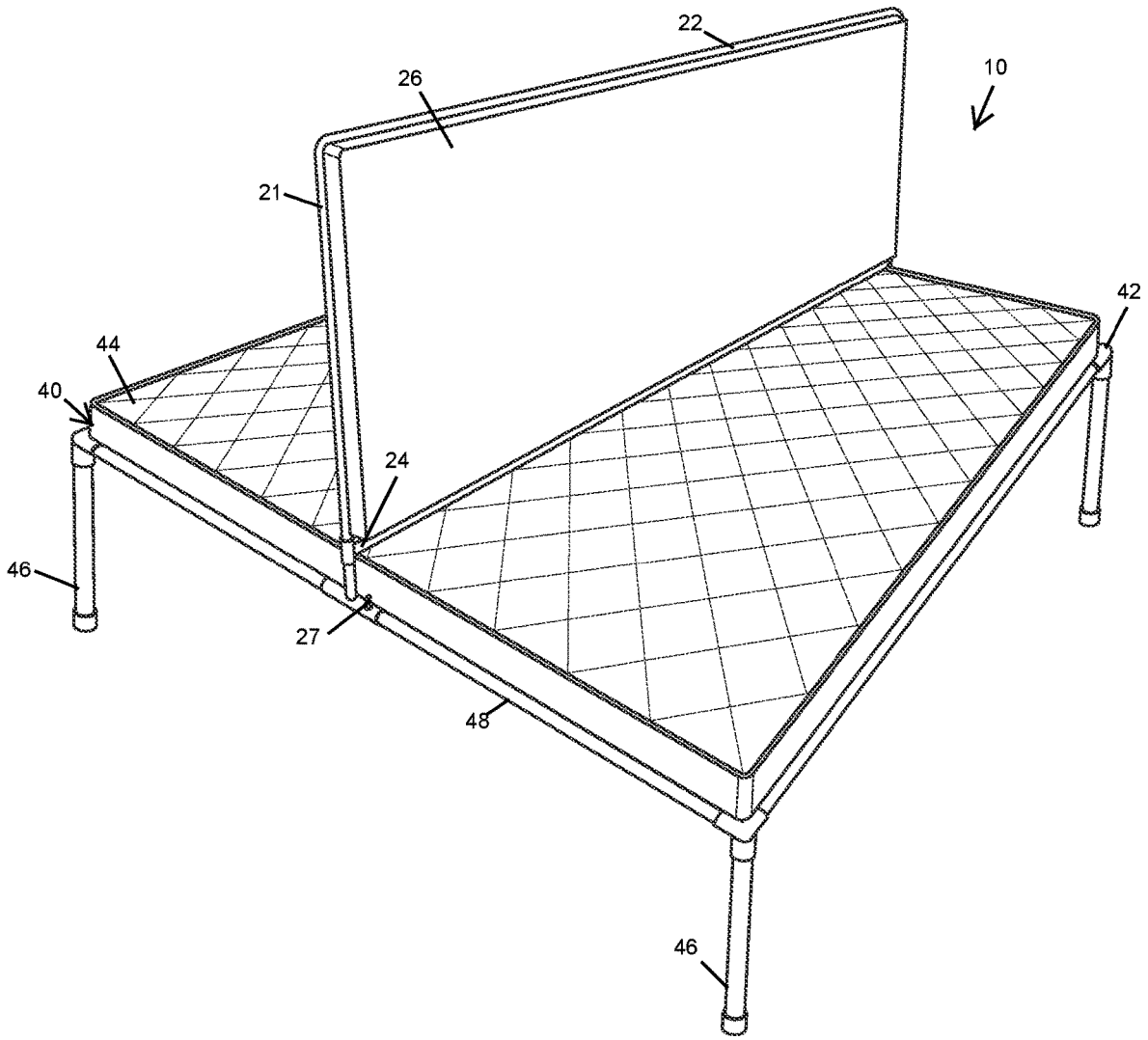

FIG. 2 shows an isometric view of the present invention 10. The backrest assembly 20 is slidably mounted to the bed assembly 40.

Figure 3:
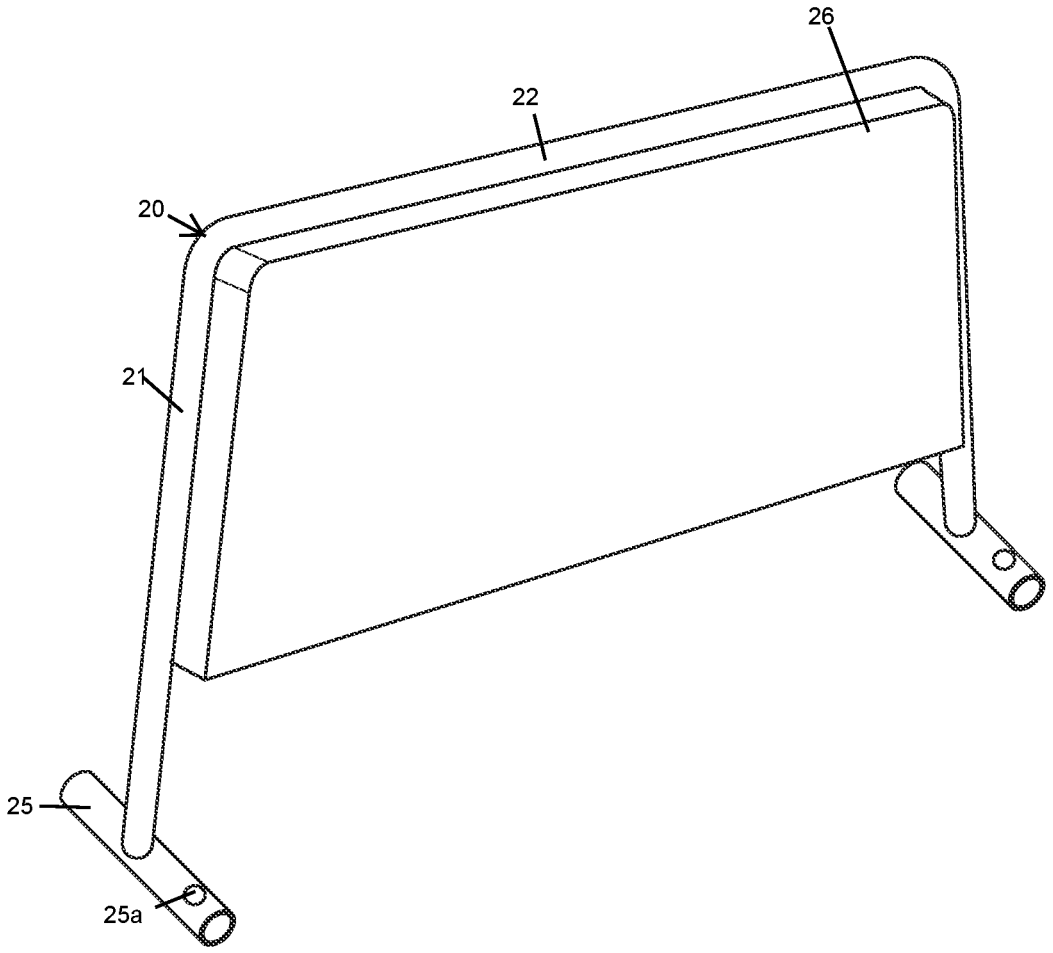

FIG. 3 illustrates an isometric view of the backrest assembly 20 showing the mounting members 25.

Figure 4:
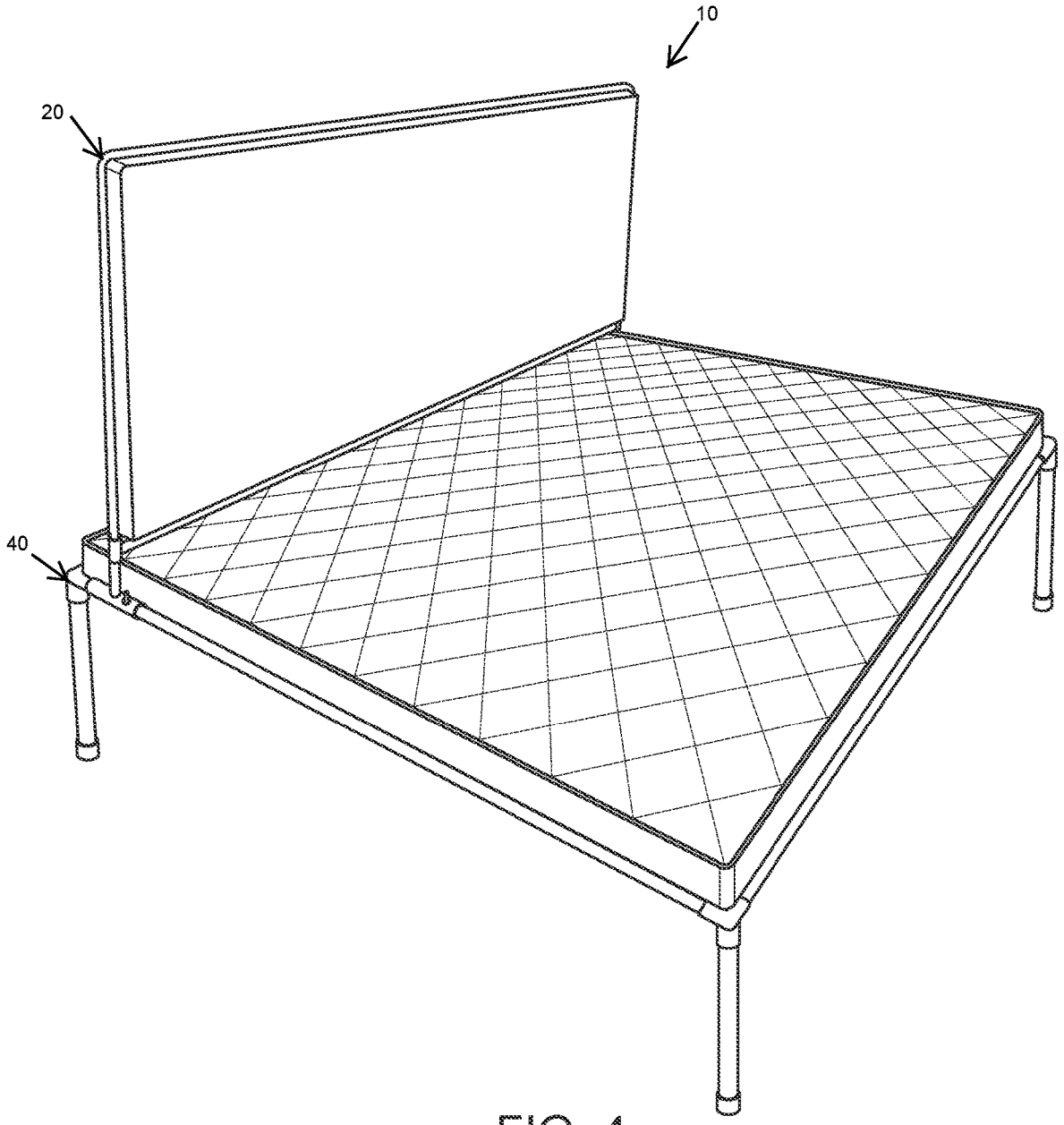

FIG. 4 is a representation of an alternative configuration of the present invention 10 with the backrest assembly 20 positioned to a rear position of the bed assembly 40.

Figure 5:
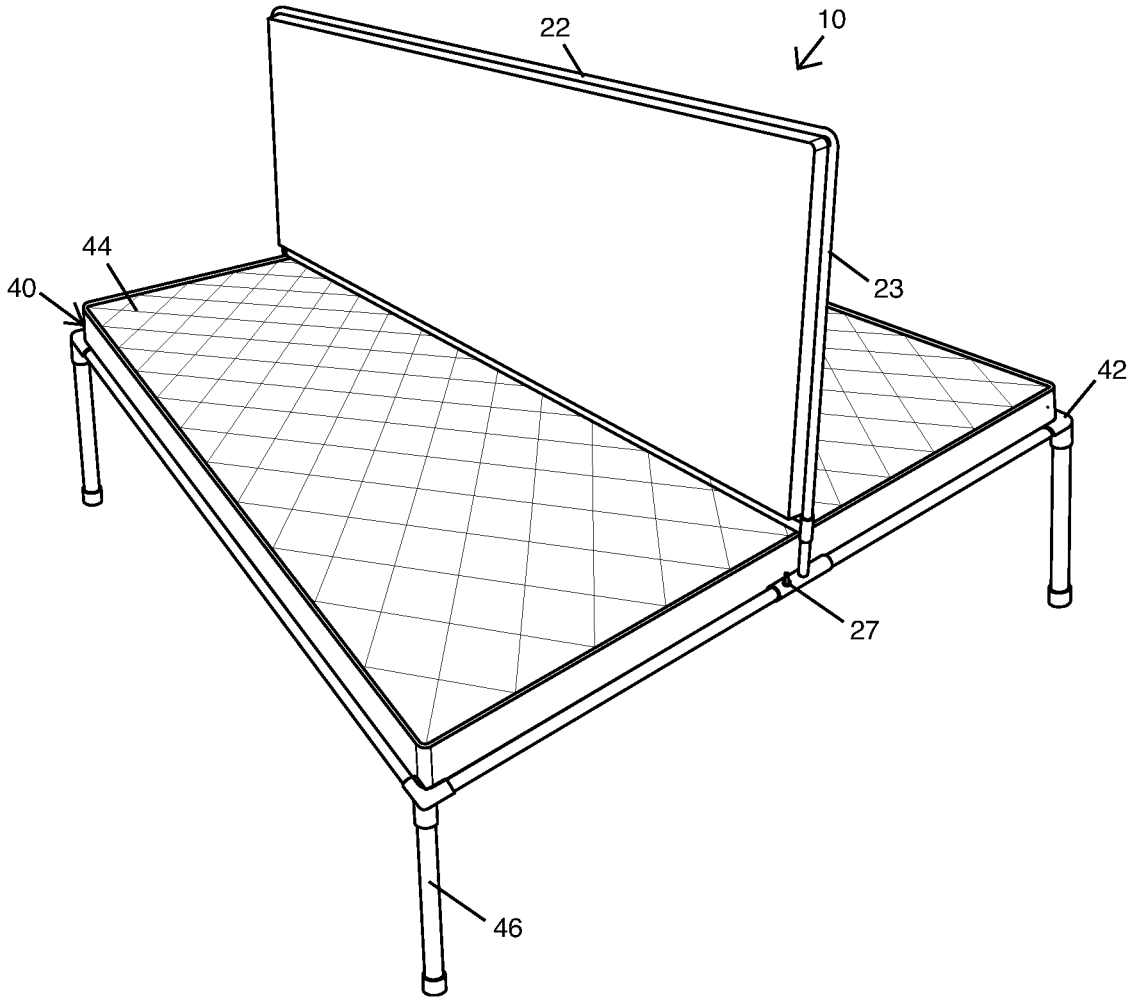

FIG. 5 shows a right perspective view of the present invention 10 wherein the right perspective view is a mirror image of the isometric view as observed in FIG. 2.

V. DETAILED DESCRIPTION OF THE EMBODIMENTS OF THE INVENTION

Referring now to the drawings, where the present invention is generally referred to with numeral 10, it can be observed that it basically includes backrest assembly 20 and bed assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Bed assembly 40 may include bed frame 42 and mattress 44. In one embodiment, the bed frame 42 may include a plurality of support posts 46. In one embodiment, the plurality of support posts 46 may have a substantially cylindrical shape. It also may be suitable to have a plurality of support posts 46 having a rectangular profile, an oval profile, a triangular profile, a polygonal profile, a helicoidal profile, a trapezoidal profile, or any other profile defining any other suitable shape for the support posts 46. The plurality of posts 46 may be made of wood, brass, iron, any other metal or any other suitable material for a frame. The plurality of posts 46 may have a protective coating to avoid oxidation.

The bed frame 42 may further include a plurality of bars 48. Preferably the plurality of bars 48 may have a cylindrical shape. It also may be suitable to have the plurality of bars 48 having a rectangular profile, an oval profile, an elliptical profile, a triangular profile or the like. Preferably the plurality of bars 48 may be straight. The plurality of bars 48 may be made of wood, brass, iron, any other metal or any other suitable material for a frame. The plurality of bars 48 may have a protective coating to avoid oxidation. In a preferred embodiment, the bed frame 42 may have four of the plurality of bars 48 perpendicularly connected one to each other. The plurality of bars 48 may be connected using welding, glue, nails, bolts, rivets, connectors, threaded portions, screws or any other fastener known in the prior art. The plurality of bars 48 may define a bed frame 42 with a rectangular shape having lateral bars and front and rear bars. One of the plurality of posts 46 may be perpendicularly connected to each distal end of the plurality of bars 48. The plurality of bars 48 may be connected to the plurality of posts 46 using welding, threaded portions, connectors, rivets, nails, screws, or the like. The plurality of posts 46 may elevate the frame bed 42 from the floor. The mattress 44 may be of twin size, twin XL size, full size, queen size, king size or any other size. The mattress 44 may be made of cotton, polyester, memory foam, or any other suitable material for a mattress.

The backrest assembly 20 may include a first rod 21, a second rod 22 and a third rod 23. The first rod 21 and third rod 23 may have substantially same length. It also may be suitable to have the first rod 21 with a bigger or smaller length than the third rod 23. The first rod 21, second rod 22 and third rod 23 may have a substantially cylindrical shape. It also may be suitable to have the first rod 21, second rod 22 and third rod 23 with other shape such as rectangular profile shape, oval profile shape, or any other suitable shape. In one embodiment, the second rod 22 may have same length as one of the plurality of bars 48 of the bed frame 42. It also may be suitable to have the second rod 22 with a smaller length than the plurality of bars 48. The first rod 21 may be perpendicularly connected to a left end of the second rod 22. The third rod 23 may be perpendicularly connected to a right end of the second rod 22. The third rod 23 and the first rod 21 may be parallel in the same plane. A fourth rod 24 may be connected to a bottom portion of the first rod 21 and third rod 23. The fourth rod 24 may be parallel to the second rod 24. The fourth rod 24 may be located at a predetermined distance of the first rod 21 and third rod 23 to allow a space for the mattress 44. The first rod 21, second rod 22, third rod 23 and fourth rod 24 may be connected by welding, screws, bolts, connectors, rivets, threaded portions or the like. It also may be suitable to have the first rod 21, second rod 22 and third rod 23 as a single bended piece of a metal or wood. The first rod 21, second rod 22, third rod 23 and fourth rod 24 may be made of wood, a metal or the like. It also may be suitable to have the first rod 21, second rod 22, third rod 23 and fourth rod 24 made of polyvinyl chloride. The backrest assembly 20 may further include pad 26. Pad 26 may have a substantially rectangular shape. It should be understood that pad 26 may have any other shape. The pad 26 may be a cushion pad. The pad 26 may be made of cotton, polyester, memory foam, or any other comfortable material. Pad 26 may be fixed between the first rod 21, second rod 22 and third rod 23.

The backrest assembly 20 may further include mounting members 25 attached to lower distal ends of the first rod 21 and the third rod 23. The mounting members 25 may be connected to the first rod 21 and third rod 23 by welding, glue, rivets, or the like. The mounting members may be made of wood, metal, polyvinyl chloride or the like. The mounting members 25 may be cylindrical and hollow. The mounting members 25 may have any other suitable shape that allows the plurality of bars 48 fit therein. The mounting members 25 may be slidably mounted to the plurality of bars 48 to allow the backrest to slide along a length of the bed frame 42 so a user can adjust the backrest assembly 20 for comfort. The mounting members 25 may include openings 25*a* to receive locking pins 27 therein to fix a desired position of the backrest assembly 40 along the bed frame 42. It should be understood that the backrest assembly 20 may be removable. It should be understood that the backrest assembly 20 may be installed to any suitable bedframe.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bed with an adjustable backrest, consisting of:

A) a bed assembly including a bed frame, wherein the bed frame is made of metal, wherein the bed frame has lateral cylindrical bars; and B) a backrest assembly including a first rod, a second rod, a third rod and a fourth rod, wherein the first rod is connected to a left end of the second rod, a right end of the second rod is connected to the third rod and the fourth rod is connected to a bottom portion of the first rod and the third rod, wherein the backrest assembly further includes mounting members attached to lower distal ends of the first rod and the third rod, wherein said mounting members have a cylindrical shape, wherein said mounting members are hollow, wherein said mounting members are slidably mounted to the lateral cylindrical bars of the bed frame, wherein the mounting members include a locking pin to fix a position of the backrest assembly, wherein the backrest assembly includes a cushion pad.

* * * * *